US012660845B2

(12) United States Patent
Fiscella et al.

(10) Patent No.: US 12,660,845 B2
(45) **Date of Patent: *Jun. 23, 2026**

(54) APPARATUS AND METHOD FOR FILLING SMOKING CONES

(71) Applicants: Anthony S. Fiscella, Gilbert, AZ (US); Joseph Fiscella, Anaheim, CA (US)

(72) Inventors: Anthony S. Fiscella, Gilbert, AZ (US); Joseph Fiscella, Anaheim, CA (US)

( * ) Notice: Subject to any disclaimer, the term of this patent is extended or adjusted under 35 U.S.C. 154(b) by 498 days.

This patent is subject to a terminal disclaimer.

(21) Appl. No.: 18/198,958

(22) Filed: May 18, 2023

(65) Prior Publication Data

US 2024/0358062 A1 Oct. 31, 2024

Related U.S. Application Data

(63) Continuation-in-part of application No. 18/138,783, filed on Apr. 25, 2023, now Pat. No. 12,478,093.

(51) Int. Cl.
*A24C 5/04* (2006.01)

(52) U.S. Cl.
CPC ..... *A24C 5/04* (2013.01)

(58) Field of Classification Search
None
See application file for complete search history.

*Primary Examiner* — Phu H Nguyen
(74) *Attorney, Agent, or Firm* — Bruce A. Lev

(57) ABSTRACT

An apparatus and method for filling smoking cones includes an elongated hollow body having a cone connector nozzle on one end, a push-rod opening at an opposite end, and a filler port on one side thereof. An elongated locking cap is included and used to support and releasably retain a smoking cone to the cone connector nozzle, along with a spike inserted therethrough to form a central aperture within the smoking cone after filling, and a push-rod used to push smoking material placed within the filler port into the smoking cone.

8 Claims, 9 Drawing Sheets

APPARATUS AND METHOD FOR FILLING SMOKING CONES

CROSS-REFERENCE TO RELATED APPLICATION

The present application is related to and claims priority from prior non-provisional application Ser. No. 18/138,783, filed Apr. 25, 2023 which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to smoking cones, and more specifically to apparatuses and methods for filling smoking cones.

2. Description of the Related Art

Prior art apparatus and method for filling smoking cones use push-rods and funnel-like mechanisms to fill smoking cones. However, this becomes difficult and messy when transferring smoking material from a tray or vessel into the funnel and subsequently into the smoking cone. These inefficient apparatuses and methods results in significant losses of smoking material, and lots of extra effort cleaning up messes left behind. Accordingly, the present invention overcomes the disadvantages associated with the prior art, by providing an apparatus and method for filling smoking cones that includes a hollow body having a filler port on one side thereof adapted to be placed upon a tray or the like full of smoking material, such that the smoking material can be easily and efficiently placed within the interior of the hollow cylindrical body via the filler port, and then pushed within a smoking cone.

BRIEF SUMMARY OF THE INVENTION

In view of the foregoing disadvantages inherent in the known types of apparatuses and methods for filling smoking cones, the instant invention sets forth an apparatus and method for filling smoking cones includes an elongated hollow body having a cone connector nozzle on one end, a push-rod opening at an opposite end, and a filler port on one side thereof. An elongated locking cap is included and used to support and releasably retain a smoking cone to the cone connector nozzle, along with a spike inserted therethrough to form a central aperture within the smoking cone after filling, and a push-rod used to push smoking material placed within the filler port into the smoking cone, with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
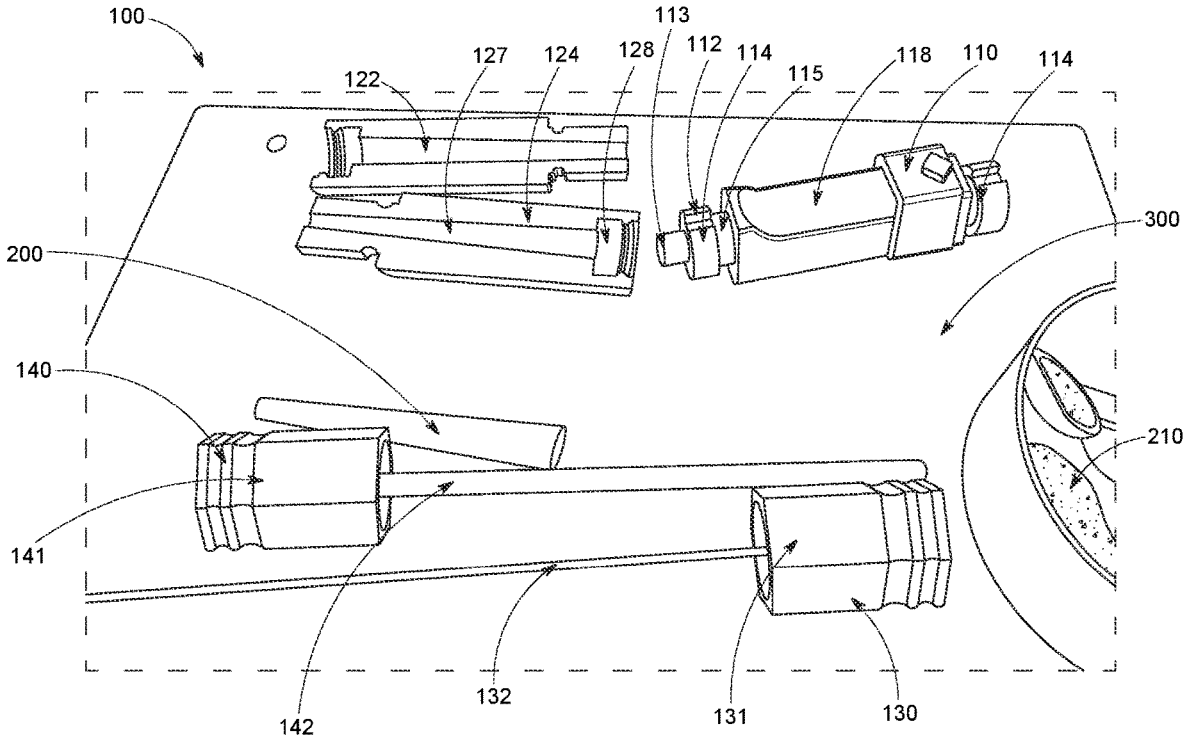
FIG. 1 shows a perspective view of the pieces of the apparatus for filling smoking cones according to the preferred embodiment of the present invention.
Figure 2:
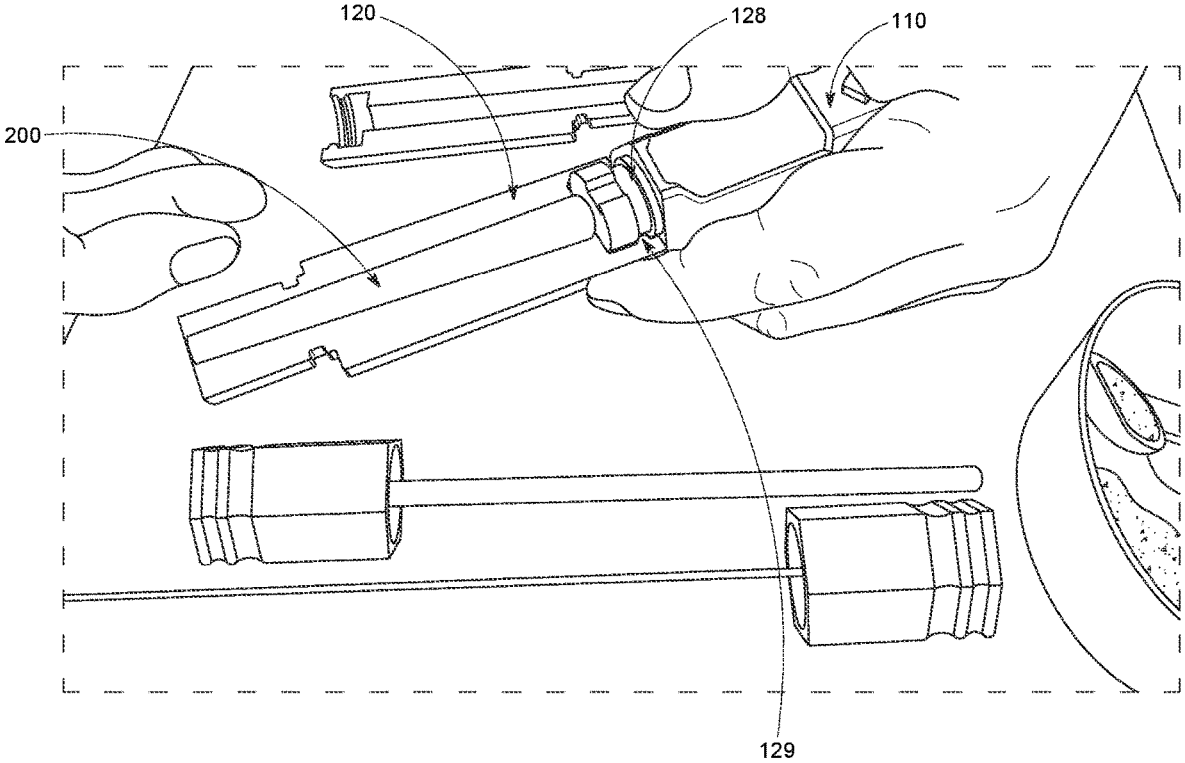
FIG. 2 shows a perspective view of one half of the locking cap attached to the cone connector nozzle along with a smoking cone attached to the cylindrical nozzle according to the preferred embodiment of the present invention of FIG. 1.
Figure 3:
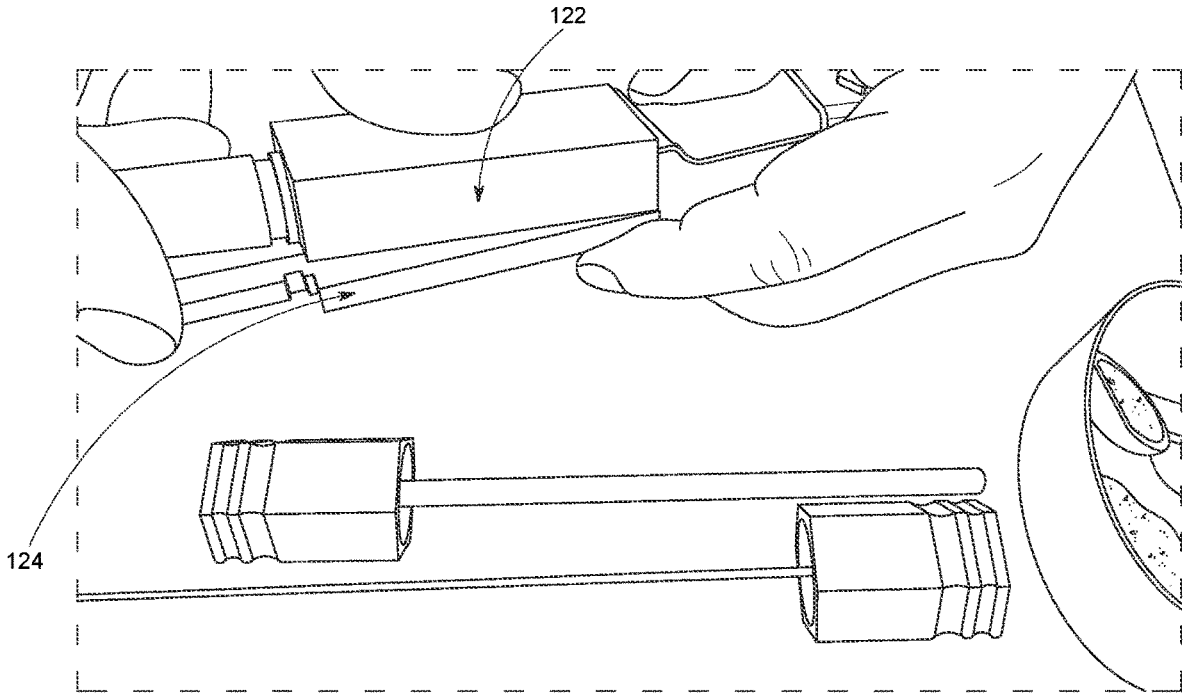
FIG. 3 shows a perspective view of the other half of the locking cap being attached to the cone connector nozzle according to the preferred embodiment of the present invention of FIG. 1.
Figure 4:
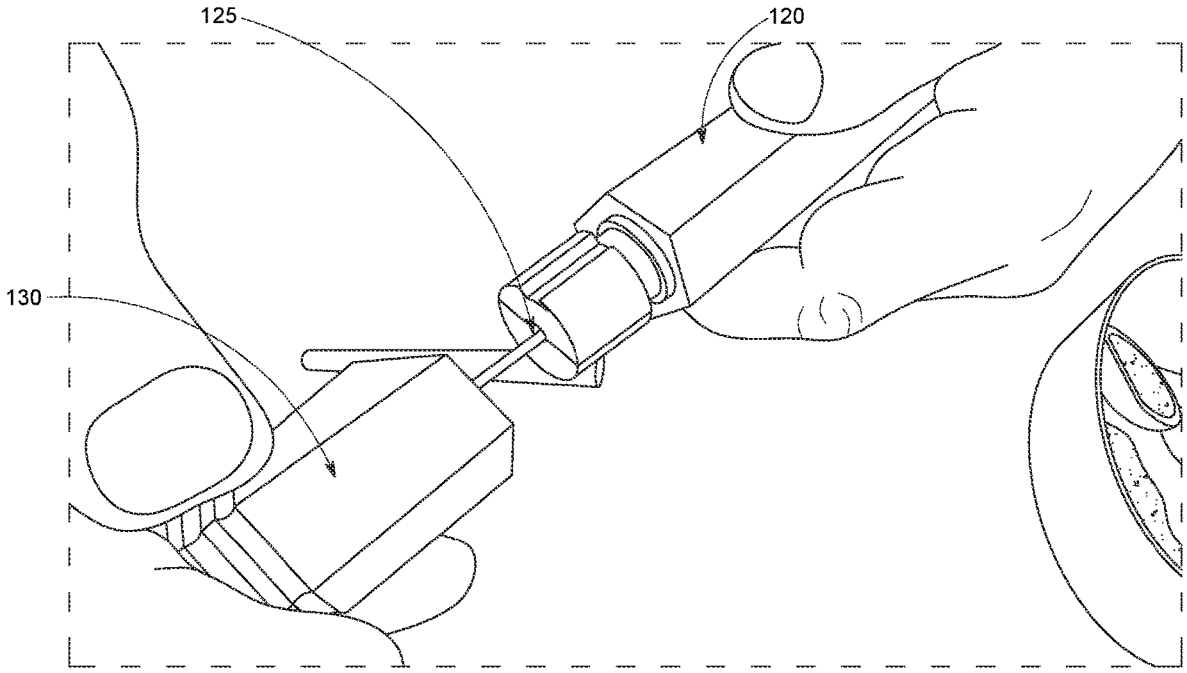
FIG. 4 shows a perspective view of the spike being inserted within the locking cap and smoking cone according to the preferred embodiment of the present invention of FIG. 1.
Figure 5:
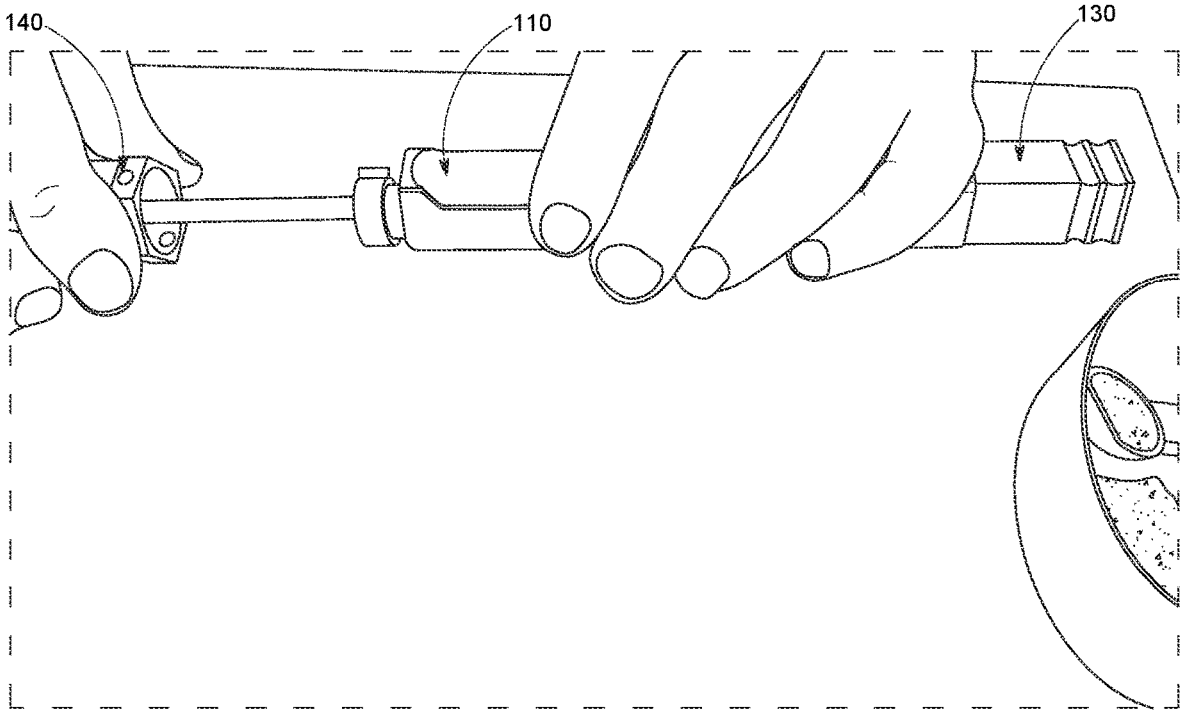
FIG. 5 shows a perspective view of the push rod being inserted into the push-rod opening of the hollow cylindrical body according to the preferred embodiment of the present invention of FIG. 1.
Figure 6:
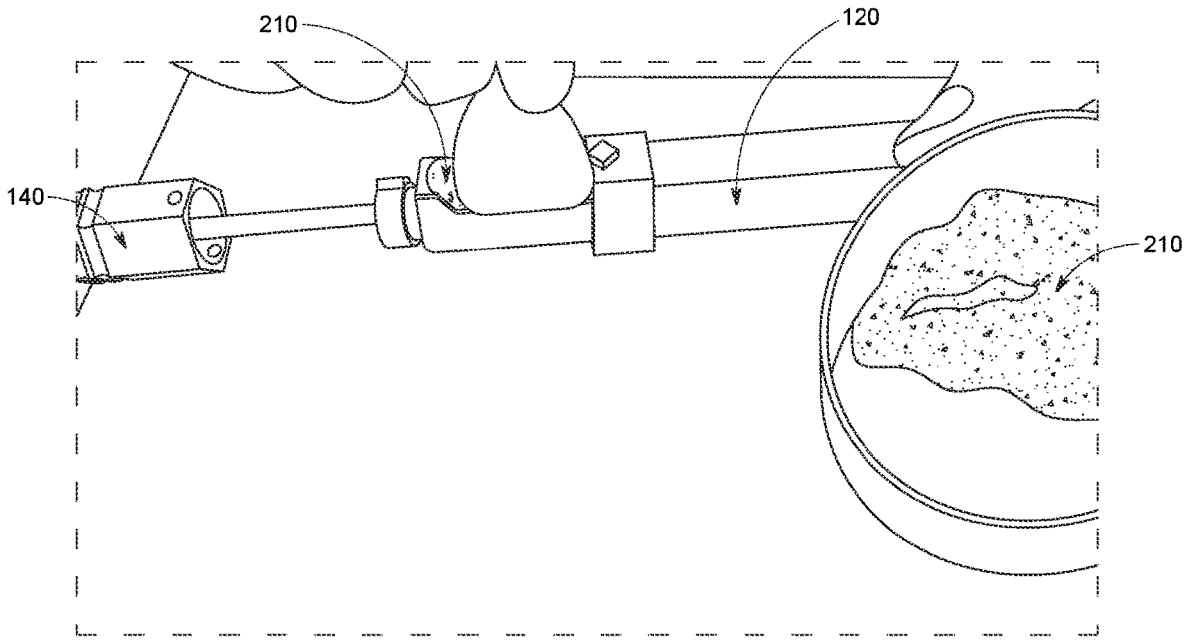
FIG. 6 shows a perspective view of smoking material being placed within the filler port of the elongated hollow body according to the preferred embodiment of the present invention of FIG. 1.
Figure 7:
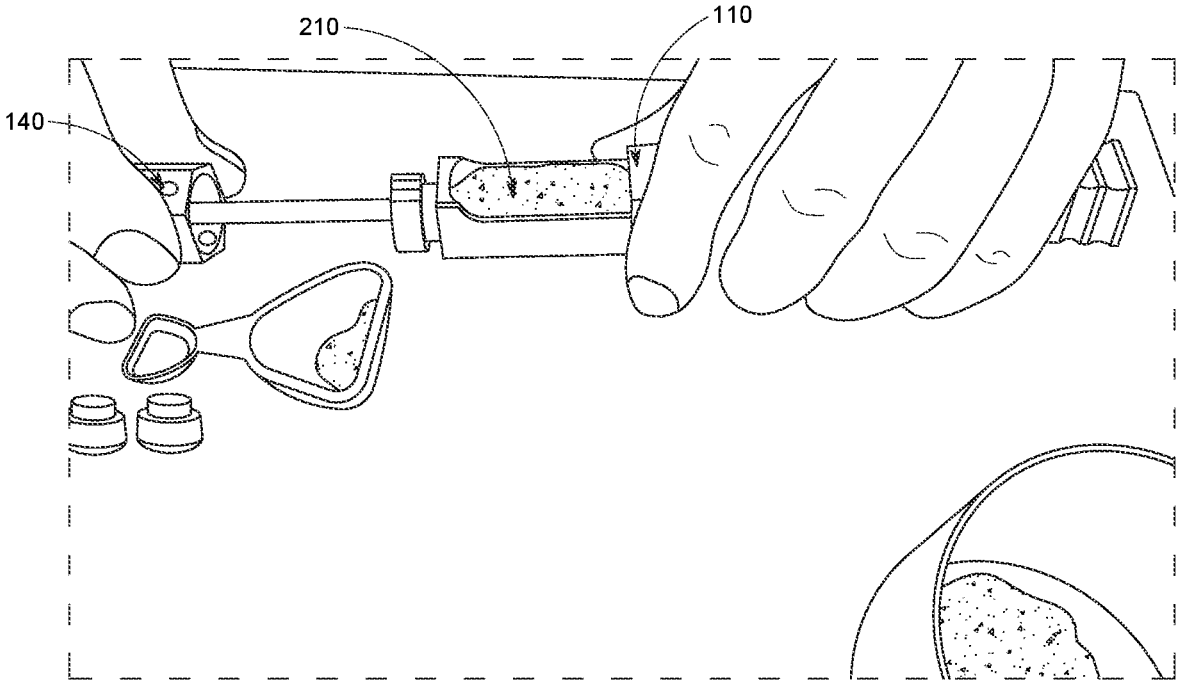
FIG. 7 shows a perspective view of the smoking material being pushed by the push rod into the smoking cone according to the preferred embodiment of the present invention of FIG. 1.
Figure 8:
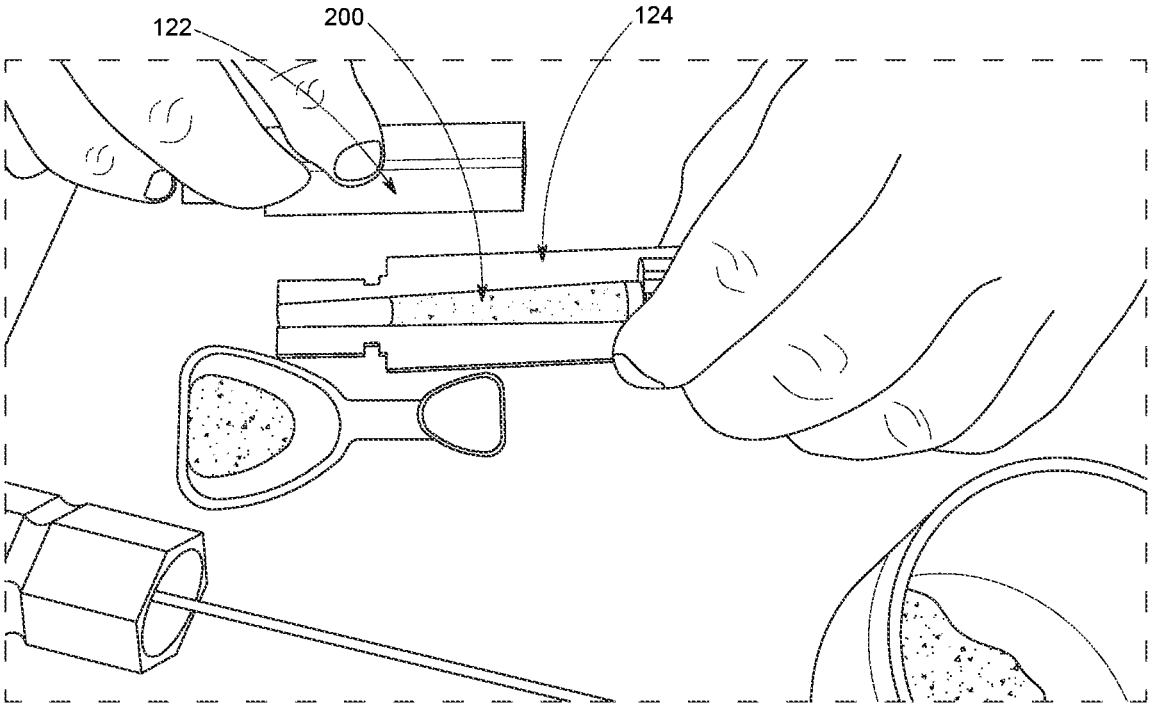
FIG. 8 shows a perspective view of the locking cap being opened and showing the packed smoking cone according to the preferred embodiment of the present invention of FIG. 1.
Figure 9:
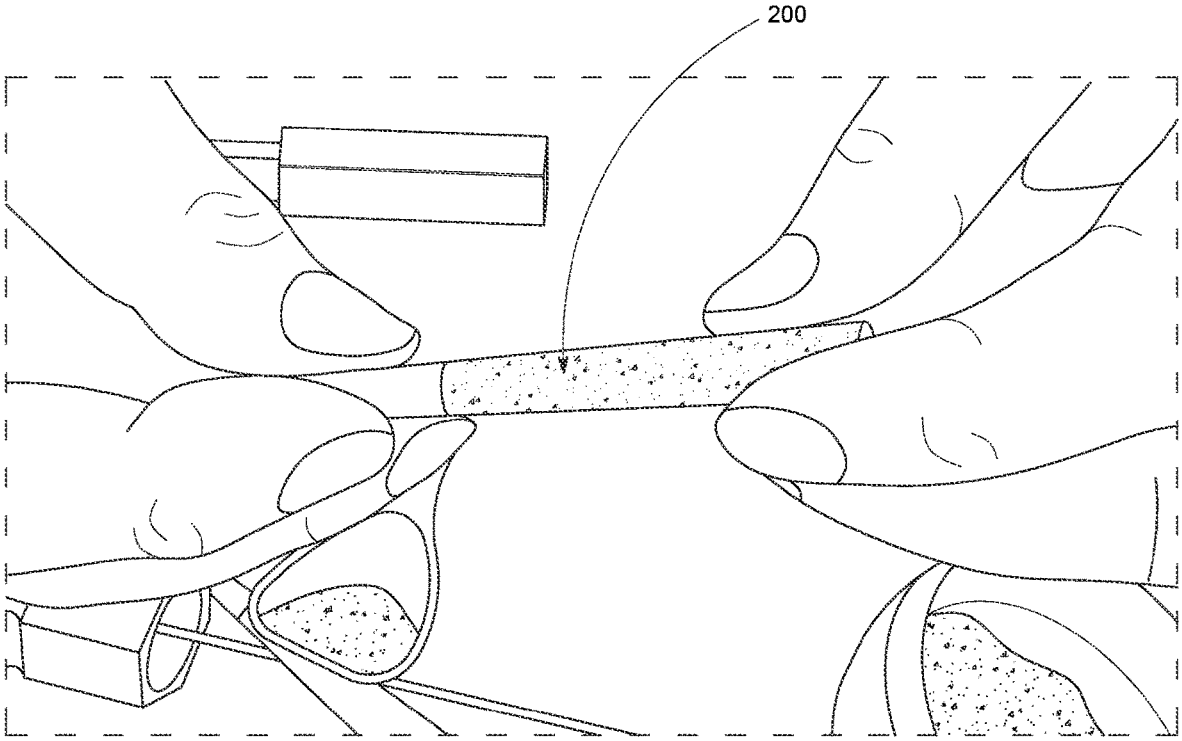
FIG. 9 shows a perspective view of the packed smoking cone removed from the apparatus according to the preferred embodiment of the present invention of FIG. 1.

Turning now descriptively to drawing, referring to FIGS. 1-9, the present invention discloses an apparatus for filling smoking cones 100 comprising an elongated hollow body 110 including a cone connector nozzle 112 including a cylindrical nipple 113 having a length and an outer diameter, an annular ring 114 located on a middle portion of the length of the cylindrical nipple, wherein the annular ring has an outer diameter larger than the outer diameter of the cylindrical nipple, and an opening therethrough, wherein the cone connector nozzle 112 is located on a distal end of the elongated hollow body and is adapted to releasably retain a smoking cone 200 on the cylindrical nipple 113, and wherein the cylindrical nipple and the annular ring form an annular groove 115, a push-rod opening 125 located on a proximal end of the elongated hollow body opposite the distal end, and a filler port 118 located on a side portion of the elongated hollow body in between the proximal and distal ends, and wherein the filler port is adapted to receive and retain smoking material 210 therein, wherein the elongated hollow body defines a length between the distal end and the proximal end; an elongated locking cap 120 including a proximal end, a distal end, a length, and a central aperture 125 including an elongated hollow tapered cylindrical recess 127 located from the distal end of the elongated locking cap and extending along a length thereof and is adapted to allow the smoking cone to be located therein, and an annular recess 128 adjacent the elongated hollow tapered cylindrical recess and the proximal end, and shaped, sized, and adapted to surround the annular ring of the cone connector nozzle, and wherein the elongated locking cap 120 is split in half along its length and forms two halves, 122 and 124, such that the two halves are adapted to releasably surround the smoking cone and be releasably connected to the distal end of the elongated hollow body to thereby releasably retain the smoking cone to the cylindrical nipple of the cone connector nozzle; a spike 130 including a handle 131 and an elongated rod 132, wherein the elongated rod is attached to the handle and extends therefrom, wherein the spike is adapted be inserted through the central aperture of the elongated locking cap and through the smoking cone to thereby form a central opening through the smoking cone after the smoking cone is filled with the smoking material and the spike removed; a push-rod 140 including a handle 141, and an elongated rod 142 attached to the handle and extends therefrom, wherein the push-rod is adapted to be movably placed through the push-rod opening of the hollow cylindrical body and push the smoking material placed within the hollow cylindrical body filler port through the opening in the cone connector nozzle and into the smoking cone.

When in use, the hollow cylindrical body 110 is adapted to be placed adjacent a tray 300 having smoking material 210 thereon and filled with a portion of the smoking material via the filler port 118, then one end of the smoking cone 200 is adapted to be releasably attached to the cylindrical nipple 113 of the cone connector nozzle, then the two halves of the locking cap are adapted to be placed around the smoking cone and releasably connected to the distal end of the hollow cylindrical body to releasably retain the smoking cone to the cone connector nozzle, then the spike 130 has a 3 mm diameter and is adapted to be inserted through the central aperture of the elongated locking cap and through the smoking cone, then the push-rod is adapted and used to push the smoking material through the opening of the cone connector nozzle from the opposite end and into the smoking cone, then the spike is removed, then the two halves of the locking cap are removed from the cone connector nozzle and the smoking cone removed from the cone connector nozzle. The resulting smoking cone has a hard packed wood-like hardness having a 3 mm airflow straw-like hole down the center. As such, powdered smoking material becomes hard pressed into a shape of a cone with a straw like hole down the center creating a vortex full of smoke when in use. With certain smoking materials, pressed trichromes saturate the material and offer a more robust high and burn significantly slower and more evenly than any conventional joint on the market. The effects are a superior smoking experience free of a user "hacking" while smoking.

The push-rod opening and the cone connector nozzle opening are linearly aligned, wherein the push-rod 140 is adapted to be movably moved back-and-forth through the push-rod opening and the cone connector nozzle at the same time. Furthermore, the elongated hollow body, the elongated locking cap, the handle of the spike, the handle of the push-rod, are formed having a hexagonal cross-section adapted to increase friction between the elongated hollow body, the elongated locking cap, the handle of the spike, the handle of the push-rod and a person's hands while in use. Furthermore, the filler port 118 has an oblong cup shape. Furthermore, the elongated hollow body, the elongated locking cap, the handle of the spike, the handle of the push-rod are formed from a material chosen from a list of materials consisting of aluminum, copper, brass, fiberglass, steel, iron, and lead. Furthermore, the annular recess 128 of the central aperture of the elongated locking cap includes a secondary annular ring 129 extending inwardly therefrom and is adapted to reside within the annular groove of the cone connector nozzle, such that when the two halves of the elongated locking cap are placed together and surround the distal end of the elongated hollow body the secondary annular ring contacts the annular ring of the cone connector nozzle and prevents the elongated locking cap from separating from the distal end of the elongated hollow body during filling of the smoking cone. And finally, the main portion of the elongated locking cap 120 has an outer radius, wherein the distal end of the locking cap is formed having an outer radius smaller than the outer radius of the main portion of the locking cap, and wherein the handle of the spike includes a hollow portion having a radius, such that the distal end of the locking cap can fit and move within the hollow portion of the handle.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. An apparatus for filling smoking cones comprising:

an elongated hollow body including:

a cone connector nozzle including:

a cylindrical nipple;

wherein said cylindrical nipple has a length and an outer diameter;

an annular ring;

wherein said annular ring is located on a middle portion of said length of said cylindrical nipple; and wherein said annular ring has an outer diameter larger than said outer diameter of said cylindrical nipple; and an opening therethrough;

wherein said cone connector nozzle is located on a distal end of said elongated hollow body, and is adapted to releasably retain a smoking cone on said cylindrical nipple; and wherein said cylindrical nipple and said annular ring form an annular groove;

a push-rod opening;

wherein said push-rod opening is located on a proximal end of said elongated hollow body opposite said distal end; and a filler port;

wherein said filler port is located on a side portion of said elongated hollow body in between said proximal and distal ends; and wherein said filler port is adapted to receive and retain smoking material therein;

wherein said elongated hollow body defines a length between said distal end and said proximal end;

an elongated locking cap including:

a proximal end;

a distal end;

a length; and a central aperture;

wherein said central aperture includes:

an elongated hollow cylindrical recess located from said distal end of said elongated locking cap and extending along a length thereof, and adapted to allow said smoking cone to be located therein; and an annular recess adjacent said elongated hollow tapered cylindrical recess and said proximal end, and shaped, sized, and adapted to surround said annular ring of said cone connector nozzle; and wherein said elongated locking cap is split in half along its length and forms two halves, such that said two halves are adapted to releasably surround said smoking cone and be releasably connected to said distal end of said elongated hollow body to thereby releasably retain said smoking cone to said cylindrical nipple of said cone connector nozzle;

a spike including:

a handle; and an elongated rod;

wherein said elongated rod is attached to said handle and extends therefrom;

wherein said spike is adapted be inserted through said central aperture of said elongated locking cap and through said smoking cone to thereby form a central opening through said smoking cone after said smoking cone is filled with said smoking material and said spike removed;

a push-rod including:

a handle; and an elongated rod;

wherein said elongated rod is attached to said handle and extends therefrom;

wherein said push-rod is adapted to be movably placed through said push-rod opening of said elongated hollow body and push said smoking material placed within said elongated hollow body filler port through said opening in said cone connector nozzle and into said smoking cone;

wherein said hollow cylindrical body is adapted to be placed adjacent a tray having smoking material thereon and filled with a portion of said smoking material via said filler port; then one end of said smoking cone is adapted to be releasably attached to said cylindrical nipple of said cone connector nozzle; then said two halves of said locking cap are adapted to be placed around said smoking cone and releasably connected to said distal end of said elongated hollow body to releasably retain said smoking cone to said cone connector nozzle; then said spike is adapted to be inserted through said central aperture of said elongated locking cap and through said smoking cone; then said push-rod is adapted and used to push said smoking material through said opening of said cone connector nozzle and into said smoking cone; then said spike is removed; then said two halves of said locking cap are removed from said cone connector nozzle and said smoking cone removed from said cone connector nozzle.

2. The apparatus for filling smoking cones of claim 1, wherein said push-rod opening and said cone connector nozzle opening are linearly aligned; and wherein said push-rod is adapted to be movably moved back-and-forth through said push-rod opening and said cone connector nozzle at the same time.

3. The apparatus for filling smoking cones of claim 1, wherein said elongated hollow body, said elongated locking cap, said handle of said spike, said handle of said push-rod, are formed having a hexagonal cross-section adapted to increase friction between said elongated hollow body, said elongated locking cap, said handle of said spike, said handle of said push-rod and a person's hands while in use.

4. The apparatus for filling smoking cones of claim 1, wherein said filler port has an oblong cup shape.

5. The apparatus for filling smoking cones of claim 1, wherein said elongated hollow body, said elongated locking cap, said handle of said spike, said handle of said push-rod are formed from a material chosen from a list of materials consisting of aluminum, copper, brass, fiberglass, steel, iron, and lead.

6. The apparatus for filling smoking cones of claim 1, wherein said annular recess of said central aperture of said elongated locking cap includes a secondary annular ring extending inwardly therefrom and is adapted to reside within said annular groove of said cone connector nozzle, such that when said two halves of said elongated locking cap are placed together and surround said distal end of said elongated hollow body said secondary annular ring contacts said annular ring of said cone connector nozzle and prevents said elongated locking cap from separating from said distal end of said elongated hollow body during filling of said smoking cone.

7. The apparatus for filling smoking cones of claim 1, wherein a main portion of said elongated locking cap has an outer radius; wherein said distal end of said locking cap is formed having an outer radius smaller than said outer radius of said main portion of said locking cap; and wherein said handle of said spike includes a hollow portion having a radius, such that said distal end of said locking cap can fit and move within said hollow portion of said handle.

8. The apparatus for filling smoking cones of claim 1, wherein said elongated hollow cylindrical recess of said central aperture of said elongated locking cap is tapered from said from said distal end of said elongated locking cap to said annular recess thereof, thereby forming a cone shape adapted to hold a smoking cone therein to be filled.

* * * * *